US012716636B2

(12) United States Patent
Wang et al.

(10) Patent No.: US 12,716,636 B2
(45) Date of Patent: Aug. 25, 2026

(54) AGING DRAWER AND REFRIGERATION APPARATUS WITH THE SAME

(71) Applicants: QINGDAO HAIER REFRIGERATOR CO., LTD., Qingdao (CN); HAIER SMART HOME CO., LTD., Qingdao (CN)

(72) Inventors: Chunli Wang, Qingdao (CN); Hao Zhang, Qingdao (CN); Tong Chen, Qingdao (CN); Zhanpeng Cui, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 113 days.

(21) Appl. No.: 18/714,446

(22) PCT Filed: Oct. 21, 2022

(86) PCT No.: PCT/CN2022/126736

§ 371 (c)(1),
(2) Date: May 29, 2024

(87) PCT Pub. No.: WO2023/098334

PCT Pub. Date: Jun. 8, 2023

(65) Prior Publication Data

US 2025/0020385 A1 Jan. 16, 2025

(30) Foreign Application Priority Data

Nov. 30, 2021 (CN) ..... 202111450276.6

(51) Int. Cl.
*F25D 17/06* (2006.01)

(52) U.S. Cl.
CPC ..... *F25D 17/062* (2013.01)

(58) Field of Classification Search
CPC ..... F25D 17/062; F25D 2317/061; F25D 25/025; F25D 17/042
See application file for complete search history.

(56) References Cited

U.S. PATENT DOCUMENTS

2003/0115892 A1 6/2003 Fu et al.
2025/0003666 A1 1/2025 Chen et al.

FOREIGN PATENT DOCUMENTS

CN 107044762 A 8/2017
CN 109431122 A 3/2019
(Continued)

OTHER PUBLICATIONS

English language machine translation of EP3412994 to Thanner et al. Translated Nov. 2025 (Year: 2018).*
(Continued)

*Primary Examiner* — Cassey D Bauer
(74) *Attorney, Agent, or Firm* — MUNCY, GEISSLER, OLDS & LOWE, P.C.

(57) ABSTRACT

An aging drawer and refrigeration apparatus with the same. The aging drawer comprises a shell, at least one air duct board provided within the shell and a circulation fan. The shell and the at least one air duct board define a aging chamber and at least one air supply duct, the aging chamber is connected to the air supply duct through multiple air outlet supply ports arranged along the direction of airflow within the air supply duct; and at least an air supply section of the air supply duct, which is directly connected to the multiple air outlets, is configured to gradually taper along the direction of airflow therein, thereby ensuring the airflow passes through the air supply section at a uniform speed at different positions, and improving the aging effect.

6 Claims, 6 Drawing Sheets

(56) References Cited

FOREIGN PATENT DOCUMENTS

| | | | | | |
|---|---|---|---|---|---|
| CN | 109827375 | A | | 5/2019 | |
| CN | 216409419 | U | | 4/2022 | |
| CN | 217446560 | U | | 9/2022 | |
| EP | 3412994 | A2 | * | 12/2018 | ..... F25C 5/22 |
| JP | 201531499 | A | | 2/2015 | |
| JP | 2019074273 | A | * | 5/2019 | |
| KR | 20050003862 | A | | 1/2005 | |
| WO | WO2021129482 | A1 | | 7/2021 | |
| WO | WO2023083074 | A1 | | 5/2023 | |

OTHER PUBLICATIONS

English language machine translation of JP2019074273 to Kobayashi et al. Translated Nov. 2025 (Year: 2019).*

* cited by examiner

AGING DRAWER AND REFRIGERATION APPARATUS WITH THE SAME

TECHNICAL FIELD

The present application relates to the field of refrigeration apparatus, and in particular, to an aging drawer and refrigerator apparatus with the same.

BACKGROUND

Aging involves placing acid-drained meat in a chamber with specific temperature, humidity, and airflow to slowly and naturally ferment, ultimately enhancing the depth of flavor, tenderness, flavor, and juiciness of the meat. In the past, the aging drawer is usually standalone, thereby requiring specially temperature control devices and humidity control devices, which makes the structure relatively complex. Moreover, when the volume of food is large, it can lead to uneven airflow over the surface of the food, which affects the aging effect.

Reference to any prior art in the specification is not, and should not be taken as, an acknowledgment or any form of suggestion that this prior art forms part of the common general knowledge in Europe or any other jurisdiction or that this prior art could reasonably be expected to be understood and regarded as relevant by a person skilled in the art.

SUMMARY

One objective of the first aspect of the present application is to overcome at least one deficiency of the prior art by providing an aging drawer for refrigeration apparatus with even airflow supply.

A further objective of the first aspect of the present application is to facilitate the structural matching of the aging drawer and the refrigerator apparatus.

Another objective of the present application is to provide a refrigerator apparatus with the aging drawer as described above.

According to the first aspect of the present application, the present application provides an aging drawer for a refrigeration apparatus for aging objects to be aged therein, the aging drawer comprising: a shell and at least one air duct board provided within the shell, the shell and the at least one air duct board define a aging chamber on the inside of the air duct board and at least one air supply duct configured to enclose at least part of the periphery outside the aging chamber, the aging chamber is connected to the air supply duct through a plurality of air outlets arranged along the direction of airflow within the air supply duct; and a circulation fan, configured to control the airflow within the air supply duct to flow towards the aging chamber through the plurality of air outlets; wherein at least an air supply section of the air supply duct, which is directly connected to the multiple air outlets, is configured to gradually taper along the direction of airflow therein, thereby ensuring the airflow passes through the air supply section at a uniform speed at different positions.

Further, wherein the air supply section comprises a starting port and an ending port in the direction of the airflow, and the ratio of the cross-sectional areas of the starting port to the ending port is positively correlated with the length of the air supply section.

Further, wherein the air supply duct also comprises a guide air section directly connected to the circulation fan, the guide air section is located upstream of the air supply section.

Further, wherein the circulation fan is located on the rear side of the shell; the air duct board is L-shaped, and the air duct board includes a rear side panel located at the rear within the shell and a lateral side panel located on one lateral side within the shell, the guide air section is defined between the rear side panel and the rear wall of the shell, and the air supply section is defined between the lateral side panel and one lateral wall of the shell; and the air outlets are provided on the lateral side panel.

Further, wherein one lateral wall of the shell extends straight in a front-to-rear direction; and the lateral side panel of the air duct board extends arranged to incline from rear to front and toward the lateral side wall of the shell, thereby causing the air supply section to gradually taper from rear to front.

Further, wherein the angle between the lateral side panel of the air duct board and the lateral wall of the shell ranges between 3° and 15°.

Further, wherein there are two air duct boards, each air duct board and the shell define an air supply duct; and the two air duct boards are symmetrically arranged on the lateral sides within the shell such that the two air supply ducts enclose the lateral sides and the rear side of the aging chamber.

Further, wherein the rear wall of the shell is provided with a protrusion projecting forwards to form a storage space on the rear side of the protrusion, the storage space is exterior of the shell, and the circulation fan is located within the storage space; the front side of the protrusion is provided with a return air inlet which allows the airflow flow from the aging chamber back to the circulation fan, an air outlet is provided on each lateral side of the protrusion, and each of the two air outlets is connected to one of the two air supply ducts respectively.

Further, wherein the circulation fan is a centrifugal fan, centrifugal fan comprise a volute and a centrifugal impeller located within the volute; each lateral side of the volute is provided with an airflow outlet, and each airflow outlet is connected to one of the two air outlets respectively; the top of the volute features an arc-shaped structure protruding upwards in the middle.

According to the second aspect of the present application, the present application provides a refrigeration apparatus comprising: a cabinet that defines a storage space for storing objects; and an aging drawer described above, the aging drawer is configured to age objects therein, and the aging drawer is provided in the storage compartment.

One objective of the first aspect of this invention is to overcome at least one deficiency of the current technology by providing an aging drawer for refrigeration apparatus that ensures even airflow.

A further objective of the first aspect of this invention is to facilitate the structural compatibility of the aging drawer with the refrigeration apparatus.

The second aspect of this invention aims to provide refrigeration apparatus incorporating the aforementioned aging drawer. According to the first aspect of the invention, it provides an aging drawer for refrigeration apparatus, designed for the aging of items placed within.

In the present application, the aging drawer is applied to refrigeration apparatus, can effectively use the low-temperature environment within the refrigeration apparatus to age the objects in the aging drawer. There is no need to set up a specialized temperature control device and a humidity control device, simplifying the structure of the aging drawer and reducing the cost of the aging drawer. Moreover, the shell and the at least one air duct board define a aging chamber on the inside of the air duct board and at least one air supply duct configured to enclose at least part of the periphery outside the aging chamber. Driven by the circulating fan, the airflow within the air supply duct to flow towards the aging chamber through the plurality of air outlets. At least an air supply section of the air supply duct, which is directly connected to the multiple air outlets, is configured to gradually taper along the direction of airflow therein, thereby ensuring the airflow passes through the air supply section at a uniform speed at different positions. That is, the airflow speeds in the upstream area, downstream area and central area within the air supply section are balanced. The airflow speed entering the aging chamber through the air outlets connected to the upstream area of the air supply section, through those connected to the downstream area of the air supply section, and through those connected to the central area of the air supply section are all the sane, which ensures uniform air supply throughout the extension direction of the air supply section into the aging chamber, avoiding the problem of poor aging results caused by inadequate air blowing in some areas of the aging chamber caused by the gradually reduced airflow speed along its flow direction.

Further, the lateral side wall of the shell is set to extend straight along the direction of front and rear, and only the lateral side panel of the air duct board is arranged to incline from rear to front and toward the lateral side wall. On one hand, the air supply section can be tapered from rear to front, so as to ensure balanced airflow speed within different areas of the air supply section. On the other hand, the outer contour of the shell is more regular, so that it is ease to match the structure of the refrigerator apparatus when the aging drawer is assembled into the refrigeration apparatus, reducing the limitation and waste of space within the refrigeration apparatus.

Specific embodiments of the present application are described in detail below with reference to the accompanying drawings, and thus a person skilled in the art will better understand the foregoing and other objectives, advantages, and features of the present application.

As used herein, except where the context clearly requires otherwise, the term "comprise" and variations of the term, such as "comprising", "comprises" and "comprised", are not intended to exclude further features, components, integers or steps.

BRIEF DESCRIPTION OF THE DRAWINGS

Some specific embodiments of the present application are described in detail below in an exemplary rather than restrictive manner with reference to the accompanying drawings. The same reference numerals in the accompanying drawings denote the same or similar components or portions. A person skilled in the art should understand that these accompanying drawings are not necessarily drawn to scale. In the drawings.

DETAILED DESCRIPTION OF EMBODIMENTS

This present application initially provides an aging drawer for refrigeration apparatus, the aging drawer is configured to age objects to be aged therein. That is to say, the aging drawer of the present application, when applied to refrigeration apparatus, can effectively use the low-temperature environment within the refrigeration apparatus to age the objects in the aging drawer.

There is no need to set up a specialized temperature control device and a humidity control device, simplifying the structure of the aging drawer and reducing the cost of the aging drawer.

Figure 1:
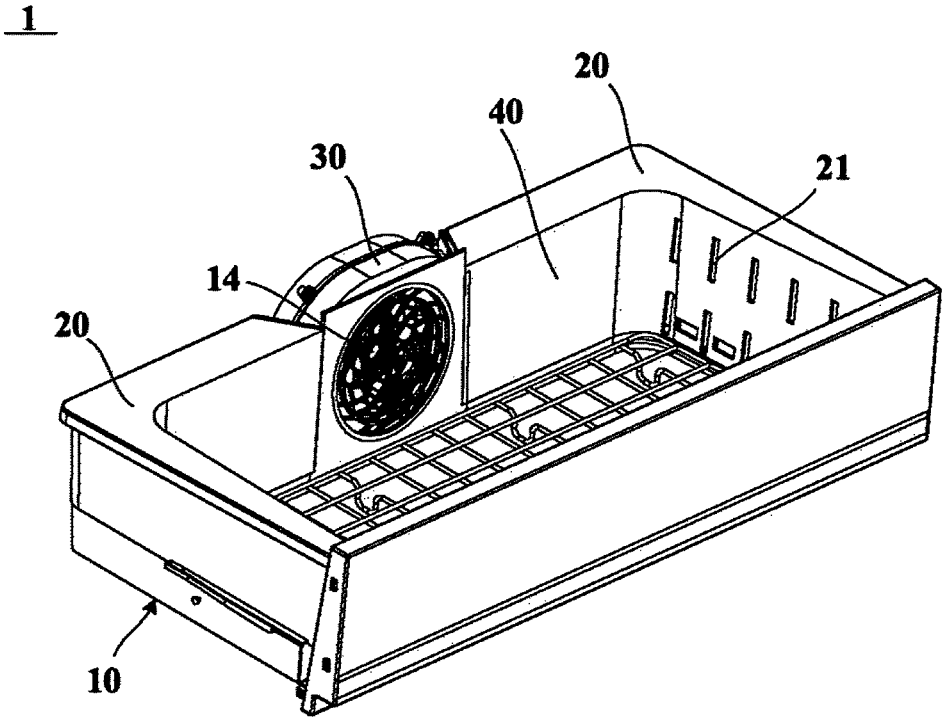
FIG. 1 is a schematic structural diagram of an aging drawer according to an embodiment of the present application.
Figure 2:
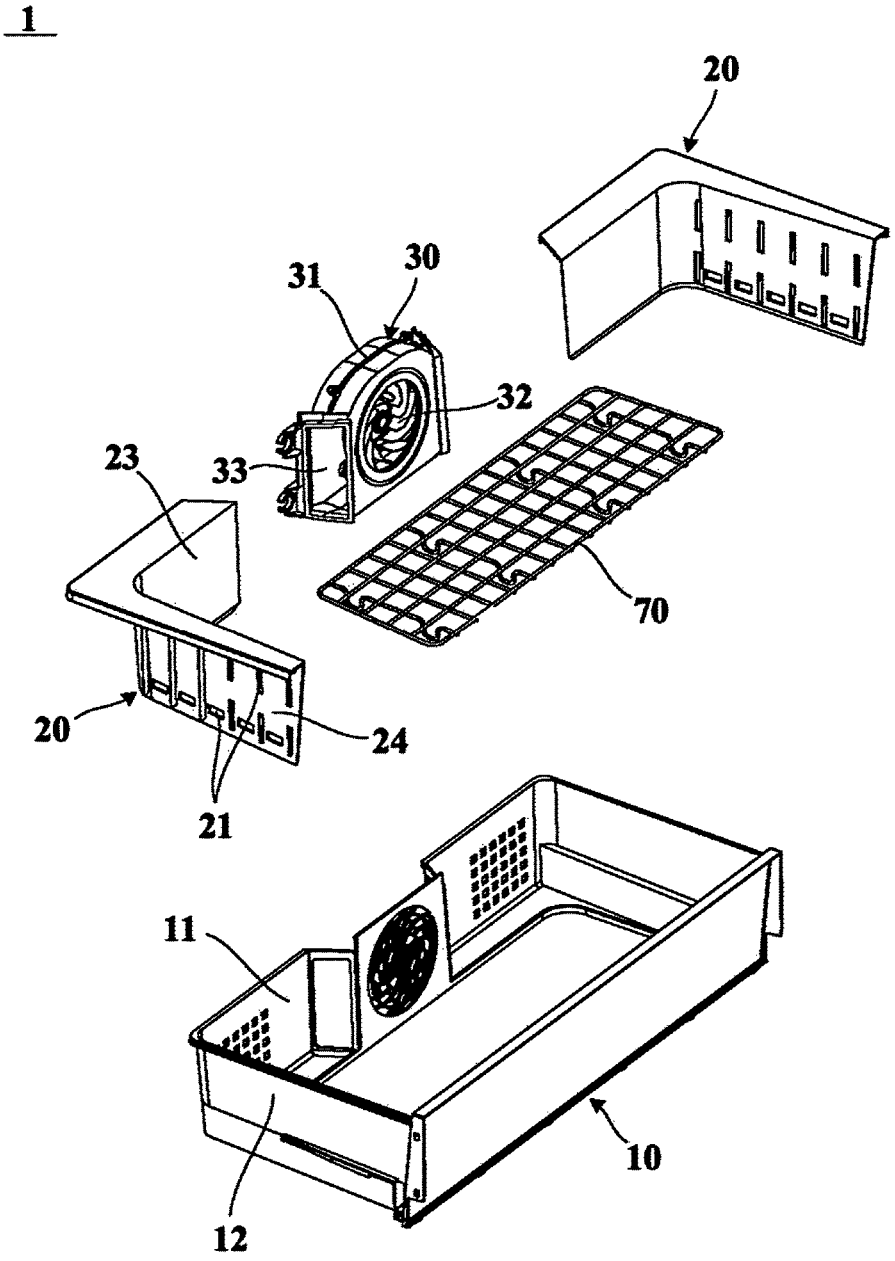
FIG. 2 is a schematic exploded view of the aging drawer according to an embodiment of the present application.
Figure 3:
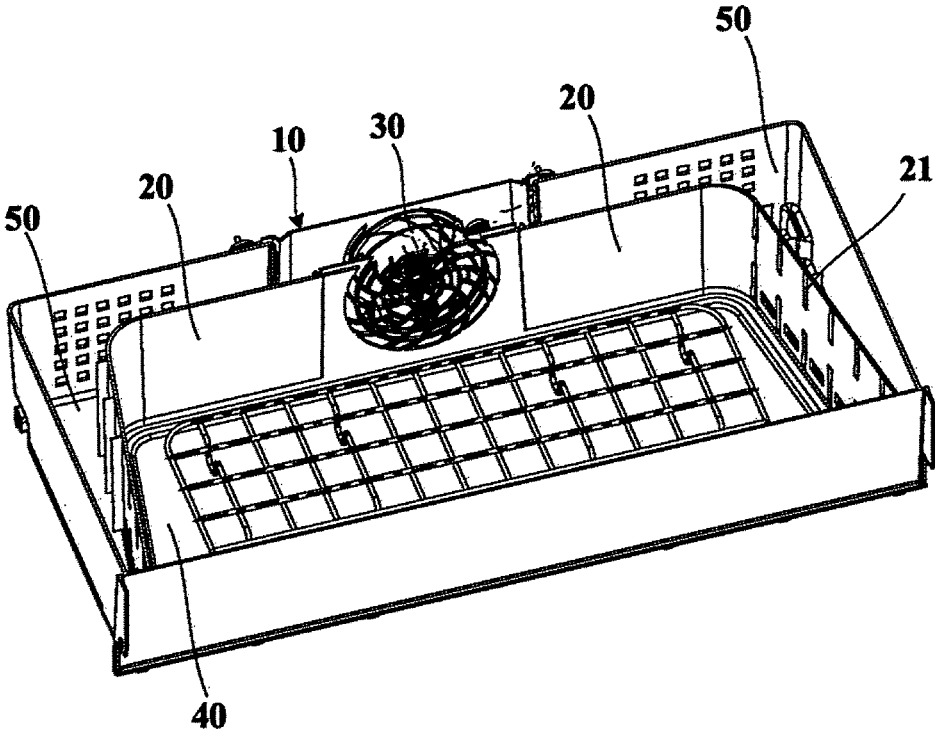
FIG. 3 is a schematic cross-sectional view of the aging drawer according to an embodiment of the present application.
Figure 4:
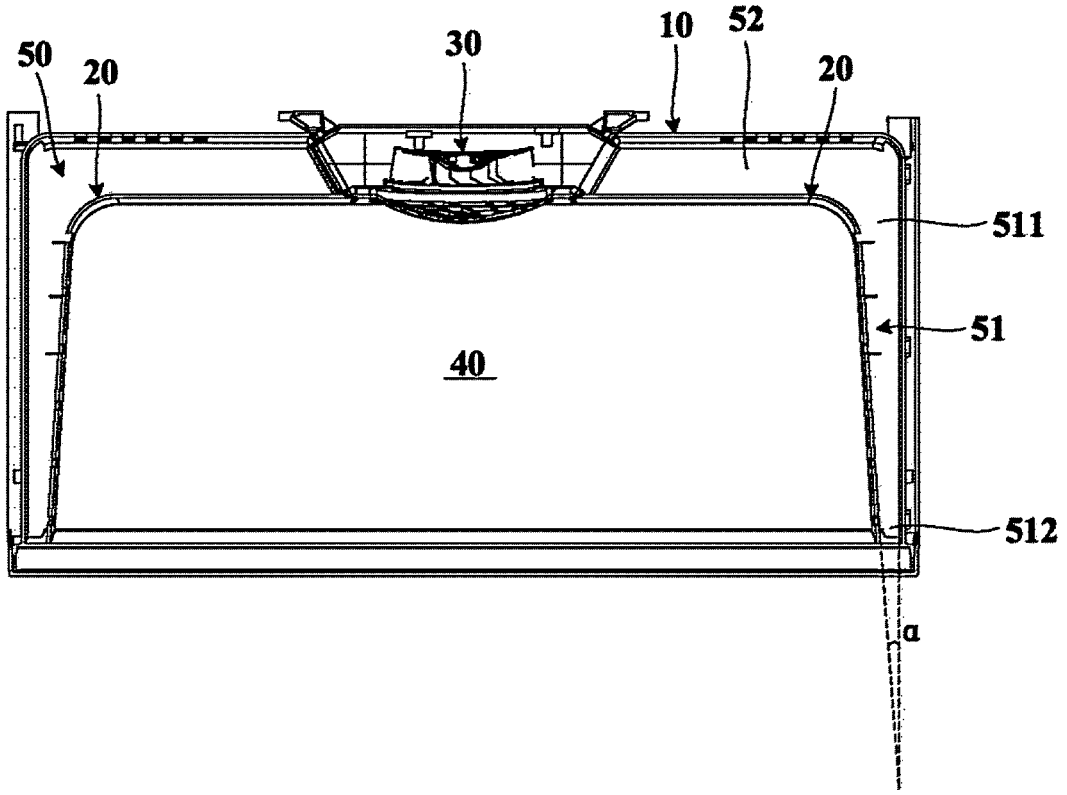
FIG. 4 is a schematic cross-sectional view of the aging drawer from a top view according to an embodiment of the present application.

FIG. 1 is a schematic structural diagram of an aging drawer according to an embodiment of the present application. FIG. 2 is a schematic exploded view of the aging drawer according to an embodiment of the present application. FIG. 3 is a schematic cross-sectional view of the aging drawer according to an embodiment of the present application. FIG. 4 is a schematic cross-sectional view of the aging drawer from a top view according to an embodiment of the present application. Referring to FIGS. 1 to 4, the aging drawer 1 comprises a shell 10, at least one air duct board 20 provided within the shell 10, and a circulation fan 30.

A aging chamber 40 and at least one air supply duct 50 are defined between the shell 10 and the at least one air duct board 20, the aging chamber 40 is positioned on the inside of the air duct board 20, and the air supply duct 50 is configured to enclose at least a portion of the circumferential outside of the aging chamber 40. The duct plate 20 is provided with a plurality of air outlets 21, the plurality of air outlets 21 being arranged along the direction of air flow within the air supply duct 50, and the aging chamber 40 is connected to the air supply duct 50 through the plurality of air outlets 21. The air supply duct 50 is disposed around the circumferential periphery of the aging chamber 40 so as to facilitate air supply from the circumferential direction of the aging chamber 40 to the aging chamber 40, which provides a wider range of air supply and facilitates uniform air supply of the objects to be aged in the aging chamber 40.

The circulation fan 30 is configured to control the airflow within the air supply duct 50 to flow towards the aging chamber 40 through multiple air outlets 21 and the airflow within the aging chamber 40 to return back to the air supply duct 50 through the return air inlet 14. Thereby, the airflow circulates between the air supply duct 50 and the aging chamber 40, driven by the circulation fan 30. In the present application, there is an additional circulation fan 30 set within the aging drawer 1, so that the air can be continuously blow into the aging chamber 40 without affected by the state of the fan within the refrigeration apparatus to achieve better aging results. Specifically, the circulation fan 30 can draw air from inside the aging chamber 40 and send it towards the air supply duct 50, causing the airflow within the air supply duct 50 to move towards the aging chamber 40 under negative pressure; or the circulation fan 30 can also draw air from the air supply duct 50 and send it towards the aging chamber 40, causing the airflow inside the aging chamber 40 to move towards the air supply duct 50 under negative pressure.

Specifically, an air supply section 51 of the air supply duct 50, which is directly connected to multiple air outlets 21, is configured to taper along the direction of airflow therein, thereby ensuring the airflow passes through the air supply section 51 at a uniform speed at different positions. It should be noted that the air supply section 51 of the air supply duct 50 directly connected to multiple air outlets 21 refers to the section corresponding to the position on the air duct board 20 where the air outlets 21 are located. However the other sections of the air supply duct 50 corresponding to the position of the air duct board 20 without air outlet 21 are not considered as the air supply section 51.

In the present application, the air supply section 51 of the air supply duct 50 formed within the aging drawer 1 is set to taper along the direction of airflow within the air supply section 51, so that the airflow passes through different positions of the air supply section 51 at a uniform speed. That is, the airflow speeds in the upstream area, downstream area and central area within the air supply section 51 are balanced. The airflow speed entering the aging chamber 40 through the air outlets 21 connected to the upstream area of the air supply section 51, through those connected to the downstream area of the air supply section 51, and through those connected to the central area of the air supply section 51 are all the same, which ensures uniform air supply throughout the extension direction of the air supply section 51 into the aging chamber 40, avoiding the problem of poor aging results caused by inadequate air blowing in some areas of the aging chamber 40 caused by the gradually reduced airflow speed along its flow direction.

In some embodiments, the air supply section 51 comprises a starting port 511 located at the upstream and an ending port 512 located at the downstream in the direction of the airflow. The ratio of the cross-sectional areas of the starting port 511 to the ending port 512 is positively correlated with the length of the air supply section 51. That is, the longer the length of the air supply section 51, the greater the ratio of the cross-sectional areas between the starting port 511 and the ending port 512, indicating a greater degree of tapering and more pronounced effect, ensuring the airflow near the ending port 52 has sufficient speed. The shorter the length of the air supply section 51, the smaller the ratio of the cross-sectional areas between the starting port 511 and the ending port 512, indicating a lesser degree of tapering and less pronounced effect, preventing the issue of increased airflow resistance and uneven flow speed caused by too rapid a decrease in the cross-sectional area of section 51.

In the present application, matching the degree of tapering of the air supply section 51 along the direction of air flow within the air supply section 51 with the length of the air supply section 51, making it easier to achieve a balanced airflow speed at each of the air outlets 21.

In some embodiments, the air supply duct 50 also includes a guide air section 52 directly connected to the circulation fan 30, the guide air section 52 is located upstream of the air supply section 51. That is, the circulation fan 30 drives the airflow to circulate by blowing air into the air supply duct 50.

In some embodiments, the circulation fan 30 is positioned on the rear side of the shell 10, which makes it less likely for users to perceive the noise generated by the operation of the circulation fan 30, and facilitates the use of one circulation fan 30 to supply air into multiple air supply ducts 50 to improve the uniformity of air supply into the aging chamber 40.

Further, the air duct board 20 is L-shaped and includes a rear side panel 23 located at the rear within the shell 10 and a lateral side panel 24 located on one lateral side within the shell 10. A guide air section 52 is defined between the rear side panel 23 and a rear wall 11 of the shell 10, and the air supply section 51 is defined between the lateral side panel 24 and one lateral wall 12 of the shell 10. Thus, the guide air section 52 extends laterally, and the air supply section 51 extends in the front-to-rear direction, with the airflow direction within the air supply section 51 moving from rear to front, and the cross-sectional area of the air supply section 51 tapering from rear to front.

Moreover, the air outlets 21 are provided on the lateral side panel 24. Specifically, multiple air outlets 21 are distributed on the lateral side panel 24 along the front-to-rear direction so as to facilitate air supply into the aging chamber 40 from various positions in the front and back directions, which improves the uniformity of air supply into the aging chamber 40 in the front-to-rear direction.

It's understood that there are multiple ways to achieve the tapering of the air supply section 51 along the direction of airflow within. Preferably, in some embodiments, one of the lateral side walls 12 of the shell 10 extends straight in the front-to-rear direction, the lateral side panel 24 of the air duct board 20 extends from rear to front while gradually near the lateral side wall 12, thus the air supply section 51 tapers from rear to front.

In the present application, the lateral side wall 12 of the shell 10 is set to extend straight along the direction of front and rear, and only the lateral side panel 24 of the air duct board 20 is arranged to incline from rear to front and toward the lateral side wall 12. On one hand, this meets the requirement for the air supply section 51 to taper from rear to front, so as to ensure balanced airflow speed within different areas of the air supply section 51. On the other hand, the outer contour of the shell 10 is more regular, so that it is ease to match the structure of the refrigerator apparatus when the aging drawer 1 is assembled into the refrigeration apparatus, reducing the limitation and waste of space within the refrigeration apparatus.

In some embodiments, the angle $\alpha$ between the lateral side panel 24 of the air duct board 20 and one lateral side wall 12 of the shell 10 ranges between 3° to 15°. For instance, the angle $\alpha$, between the lateral side panel 24 and the lateral side wall 12 can be 3°, 5°, 7°, 9°, 11°, 13°, or 15°. If the angle $\alpha$ between the lateral side panel 24 and the lateral side wall 12 is too large, the degree of tapering for the air supply section 51 is more obvious, and the lateral side panel 24 and the lateral side wall 12 generate higher resistance to airflow and greater loss of airflow speed. Conversely, if the angle $\alpha$ is too small, the tapering of the air supply section 51 is too gentle, which is not conducive to achieving the goal of balancing airflow speed through the shape of the tapering of the air supply section 51.

In some embodiments, there are two air duct boards 20, an air supply duct 50 is defined between one air duct plate 20 and the shell 10, and another air supply duct 50 is defined between another air duct plate 20 and the shell 10. The two air duct boards 20 are symmetrically arranged on the lateral sides within the shell 10 such that the two air supply ducts 50 enclose the lateral sides and the rear side of the aging chamber 40. As a result, air can be blown into the aging chamber 40 from both lateral sides simultaneously through the symmetrically arranged two air supply ducts 50, thereby improving the uniformity of airflow across the lateral direction of the aging chamber 40 and thus enhancing the aging effect of the objects to be aged.

Figure 5:
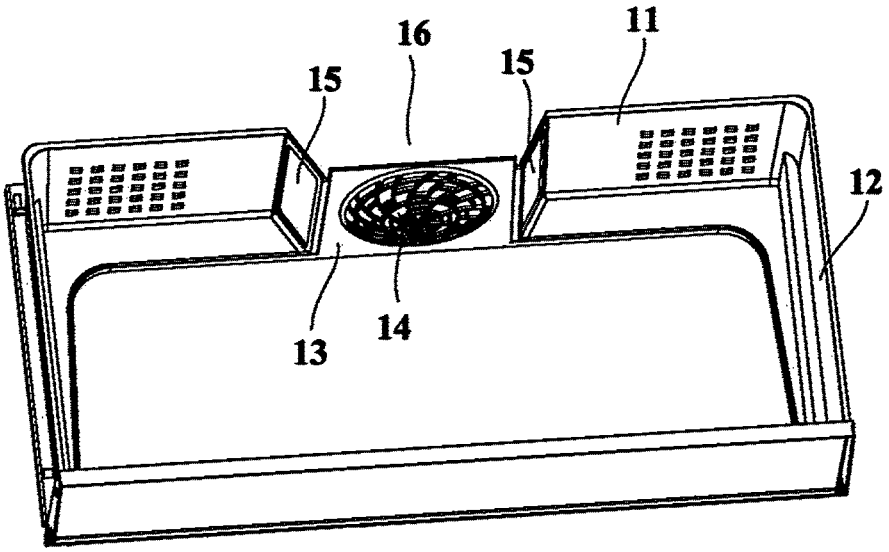
FIG. 5 is a schematic structural diagram of a shell according to an embodiment of the present application.

FIG. 5 is a schematic structural diagram of the shell according to an embodiment of the present application. In some embodiments, the rear wall 11 of the shell 10 is provided with a protrusion 13 projecting forwards to form a storage space 16 on the rear side of the protrusion 13, the storage space 16 is exterior of the shell 10, and the circulation fan 30 is located within the storage space 16. That is, the circulation fan 30 is mounted on the exterior of the shell 10, the circulation fan 30 is separated from the aging chamber 40 via the wall of the shell 10, there is no need to set additional partitions or components within the shell 10, thereby simplifying the structure and assembly process of the aging drawer 1, and improving assembly efficiency.

In some embodiments, the front side of the protrusion 13 is provided with a return air inlet 14 which allows the airflow flow from the aging chamber 40 back to the circulation fan 30. An air outlet 15 is provided on each lateral side of the protrusion 13, and each of the two air outlets 15 is connected to one of the two air supply ducts 50 respectively. Consequently, the airflow within the aging chamber 40 can flow through the return air inlet 14 to the circulation fan 30 and then return into the two air supply ducts 50 respectively under the drive of the circulation fan 30.

Further, the circulation fan 30 is a centrifugal fan. The circulation fan 30 comprises a volute 31 and a centrifugal impeller 32 positioned within the volute 31. Each lateral side of the volute 31 is provided with an airflow outlet 33, and each of the two airflow, outlets 33 is connected to one of the two air outlets 15 to supply airflow towards the two air supply ducts 40 respectively.

In the present application, a centrifugal fan supplies airflow to both air supply ducts 40 simultaneously, thereby facilitating airflow to flow into the aging chamber 40 from both lateral sides of the aging chamber 40 at the same time, which not only achieves the effect of uniform air supply, but also simplifies the structure of the aging drawer 1.

Furthermore, the top of the volute 31 features an arc-shaped structure protruding upwards in the middle. That is, the top of the volute 31 forms an arc-shaped wind guiding structure within to guide the airflow towards the two airflow outlets 33 on the lateral sides, thereby reducing airflow resistance and loss of air volume.

Moreover, the bottom of the volute 31 is nearly flat or forms an arc-shaped structure recessed downward in the middle, with the depth of the recess at the bottom of the volute 31 being less than the protrusion at the top, to minimize the space occupied by the circulation fan 30 as much as possible.

In some embodiments, a rack 70 is provided in the aging chamber 40 for placing objects to be aged. The rack 70 is set spaced apart from the bottom wall of the shell 10 to leave a space for airflow underneath the rack 70 to facilitate air flow to the underside of objects placed on the rack 70, thus ensuring that the underside of the objects can achieve a drying effect as soon as possible.

Specifically, the rack 70 is provided with a plurality of hollowed mesh holes, the hollowed mesh holes reduce the contact area between the objects to be aged and the rack 70, thereby preventing parts of the surface of the objects from spoiling due to lack of airflow contact.

Further, the height of the bottom edge of the return air inlet 14 is lower than the height of the rack 70, which benefits the airflow moving beneath the rack 70 to return to the air supply duct 50 through the bottom area of the return air inlet 14, thereby reducing the resistance of the bottom airflow and further enhancing the speed of airflow movement.

Figure 6:
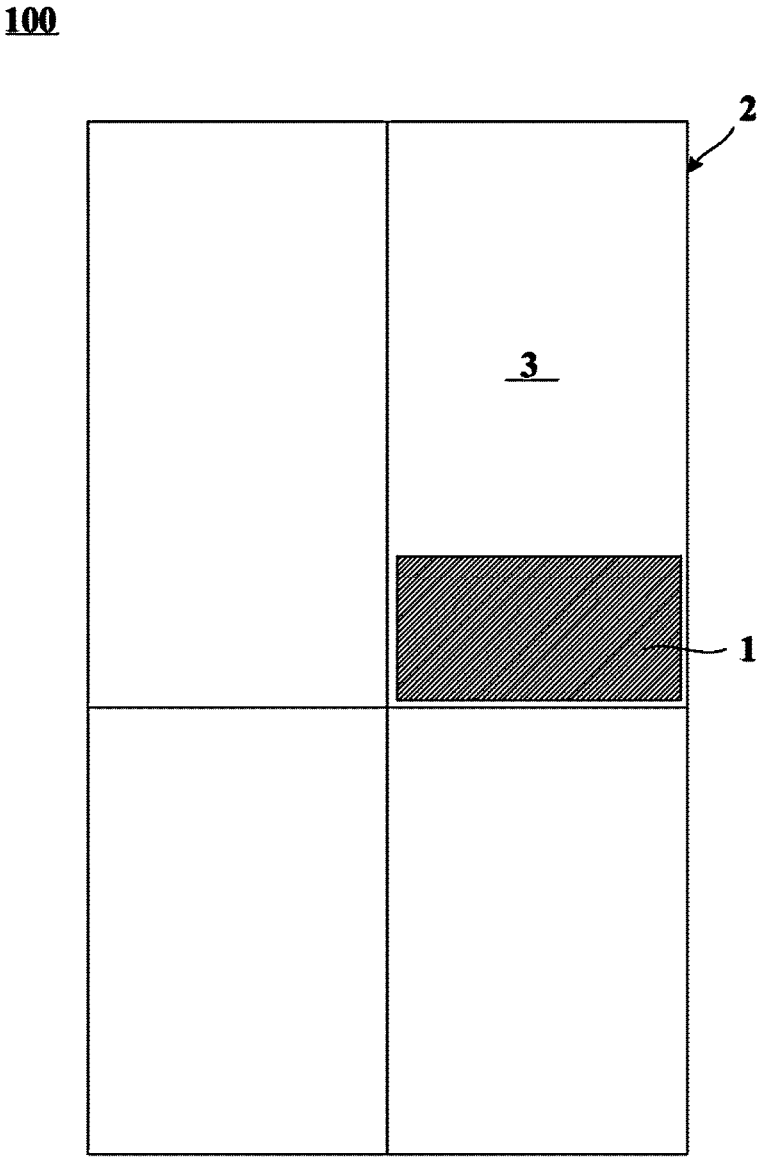
FIG. 6 is a schematic structural diagram of a refrigeration apparatus according to an embodiment of the present application.

The present application also provides a refrigeration apparatus 100, and FIG. 6 is a schematic structural diagram of a refrigeration apparatus according to an embodiment of the present application. The refrigeration apparatus 100 includes a cabinet 2, and the cabinet 2 is defined a storage compartment 3 for storing objects. In particular, the refrigeration apparatus 100 further includes the aging drawer 1 described in any of the above embodiments. The aging drawer 1 is configured to age objects therein, and the aging drawer 1 is provided in the storage compartment 3. The refrigeration apparatus 100 integrated with the aging drawer 1 not only retains the traditional function of preserving objects in a low-temperature environment but also possesses the function of aging, thereby enriching the functionalities of the refrigeration apparatus 100.

Specifically, the aging drawer 1 with an opening at the top thereof can be slid in and out of the storage compartment 3, thereby making the aging drawer 1 convenient for users to place and retrieve objects.

Furthermore, the storage compartment 3 can serve as a refrigeration chamber with a storage temperature range between 0° C. to 8° C., which is suitable for the aging temperature requirements of the objects to be aged. Moreover, the humidity level within the refrigeration chamber usually exceeds that of the indoor environment, which is more suitable for the humidity requirements of the aging process. Even if the humidity within the aging drawer 1 is not appropriate, it can be easily adjusted through the airflow within the refrigeration chamber. Therefore, the aging drawer 1 is provided within the refrigeration chamber, which can fully utilize the inherent temperature and humidity conditions of the refrigeration chamber, and significantly reduce costs.

Additionally, the cabinet 2 may also define a freezer compartment and/or a variable-temperature compartment. The refrigeration chamber, freezer compartment, and variable-temperature compartment can each be selectively opened or closed by doors pivotally mounted on the front side of the cabinet 2.

In some embodiments, the refrigeration apparatus 100 can be a standard refrigeration and freezing device. For example, the refrigeration apparatus 1 can also be a refrigerator, freezer, or cool box used for domestic or commercial purposes.

In other embodiments, the refrigeration apparatus 100 can also configured as other types of refrigeration devices such as sideboard cabinet, wine cabinet, and freezer, which require higher precision in temperature and humidity control.

Additionally, it should be noted that terms such as "horizontal," "vertical," "front," "rear," "top," and "bottom" used to describe orientations or positional relationships in the embodiments of the present application are based on the actual usage state of the aging drawer 1. These terms are used solely for the convenience of describing and understanding the technical embodiments of the present application, and are not intended to indicate or imply that the devices or components must possess specific orientations or be constructed and operated in specific orientations; hence, they should not be construed as limiting the scope of the present application.

Moreover, it is necessary to clarify that, unless otherwise clearly specified and defined, the terms "mounted", "connected", "connection", "fixed", and the like should be understood in a broad sense. For example, unless otherwise expressly defined, a connection may be a fixed connection, a detachable connection, or an integrated connection; a direct connection, or an indirect connection through an intermediate medium; or interaction between two elements. A person of ordinary skill in the art may understand specific meanings of the above terms in the present application based on specific situations.

Thus, a person skilled in the art should be aware that although a plurality of exemplary embodiments of the present application have been shown and described in detail in this description, many other variations or modifications conforming to the principle of the present application can still be determined or deduced directly according to the content disclosed in the present application, without departing from the spirit and scope of the present application. Therefore, the scope of the present application shall be understood and considered as covering all such other variations or modifications.

What is claimed is:

1. An aging drawer for a refrigeration apparatus, configured to age objects to be aged within the aging drawer, wherein the aging drawer comprising:

a shell and at least one air duct board provided within the shell, the shell and the at least one air duct board define a aging chamber on the inside of the at least one air duct board and at least one air supply duct configured to enclose at least part of periphery outside the aging chamber, the aging chamber is connected to the at least one air supply duct through a plurality of air outlets arranged along a direction of airflow within the at least one air supply duct; and a circulation fan, configured to control the airflow within the at least one air supply duct to flow towards the aging chamber through the plurality of air outlets; wherein at least an air supply section of the at least one air supply duct, which is directly connected to the plurality of air outlets, is configured to taper along the direction of airflow within the at least one air supply duct, thereby ensuring the airflow passes through the air supply section at a uniform speed at different positions;

wherein the air supply section comprises a starting port and an ending port in the direction of the airflow, and a ratio of the cross-sectional areas of the starting port to the ending port is positively correlated with a length of the air supply section;

wherein the at least one air supply duct also comprises a guide air section directly connected to the circulation fan, the guide air section is located upstream of the air supply section;

wherein the circulation fan is located on a rear side of the shell; the at least one air duct board is L-shaped, and the at least one air duct board includes a rear side panel located at a rear within the shell and a lateral side panel located on one lateral side within the shell, the guide air section is defined between the rear side panel and a rear wall of the shell, and the air supply section is defined between the lateral side panel and one lateral wall of the shell; and the air outlets are provided on the lateral side panel;

wherein there are two air duct boards, each air duct board and the shell define an air supply duct; and the one lateral side is a plurality of lateral sides and the two air duct boards are symmetrically arranged on the plurality of lateral sides within the shell such that the two air supply ducts enclose the plurality of lateral sides and a rear side of the aging chamber;

wherein a rear wall of the shell is provided with a protrusion projecting forwards to form a storage space on a rear side of the protrusion, the storage space is exterior of the shell, and the circulation fan is located within the storage space; a front side of the protrusion is provided with a return air inlet which allows the airflow flow from the aging chamber back to the circulation fan, an air outlet is provided on each lateral side of the protrusion, and each of the two air outlets is connected to one of the two air supply ducts respectively.

2. The aging drawer according to claim 1, wherein:

the one lateral wall of the shell extends straight in a front-to-rear direction; and the lateral side panel of the at least one air duct board extends arranged to incline from the rear to the front direction and toward the lateral side wall of the shell, thereby causing the air supply section to taper from the rear to the front direction.

3. The aging drawer according to claim 2, wherein:

an angle between the lateral side panel of the at least one air duct board and the lateral wall of the shell ranges between 3° and 15°.

4. The aging drawer according to claim 1, wherein:

the circulation fan is a centrifugal fan, the centrifugal fan comprise a volute and a centrifugal impeller located within the volute;

wherein the plurality of air outlets are two air outlets and each lateral side of the volute is provided with an airflow outlet, and each airflow outlet is connected to one of the two air outlets respectively;

the top of the volute features an arc-shaped structure protruding upwards in the middle.

5. A refrigeration apparatus comprising:

a cabinet that defines a storage compartment for storing objects; and an aging drawer according to claim 1, the aging drawer is configured to age objects within the aging drawer, and the aging drawer is provided in the storage compartment.

6. An aging drawer for a refrigeration apparatus, configured to age objects to be aged within the aging drawer, wherein the aging drawer comprising:

a shell and at least one air duct board provided within the shell, the shell and the at least one air duct board define a aging chamber on the inside of the at least one air duct board and at least one air supply duct configured to enclose at least part of periphery outside the aging chamber, the aging chamber is connected to the at least one air supply duct through a plurality of air outlets arranged along a direction of airflow within the at least one air supply duct; and a circulation fan, configured to control the airflow within the at least one air supply duct to flow towards the aging chamber through the plurality of air outlets; wherein at least an air supply section of the at least one air supply duct, which is directly connected to the plurality of air outlets, is configured to taper along the direction of airflow within the at least one air supply duct, thereby ensuring the airflow passes through the air supply section at a uniform speed at different positions;

wherein the air supply section comprises a starting port and an ending port in the direction of the airflow, and a ratio of the cross-sectional areas of the starting port to the ending port is positively correlated with a length of the air supply section;

wherein the at least one air supply duct also comprises a guide air section directly connected to the circulation fan, the guide air section is located upstream of the air supply section;

wherein the circulation fan is located on a rear side of the shell; the at least one air duct board is L-shaped, and the at least one air duct board includes a rear side panel located at a rear within the shell and a lateral side panel located on one lateral side within the shell, the guide air section is defined between the rear side panel and a rear wall of the shell, and the air supply section is defined between the lateral side panel and one lateral wall of the shell; and the air outlets are provided on the lateral side panel;

wherein the one lateral wall of the shell extends straight in a front-to-rear direction; and the lateral side panel of the at least one air duct board extends arranged to incline from the rear to the front direction and toward the lateral side wall of the shell, thereby causing the air supply section to taper from the rear to the front direction;

wherein an angle between the lateral side panel of the at least one air duct board and the lateral wall of the shell ranges between 3° and 15°.

* * * * *